US006994663B2

(12) United States Patent
East

(10) Patent No.: US 6,994,663 B2
(45) Date of Patent: Feb. 7, 2006

(54) SLIDER APPLICATOR

(75) Inventor: Tom East, New Palestine, IN (US)

(73) Assignee: Moorfeed Corp., Indianapolis, IN (US)

( * ) Notice: Subject to any disclaimer, the term of this patent is extended or adjusted under 35 U.S.C. 154(b) by 0 days.

(21) Appl. No.: 10/280,702

(22) Filed: Oct. 25, 2002

(65) Prior Publication Data

US 2004/0082456 A1 Apr. 29, 2004

(51) Int. Cl.
*B31B 1/90* (2006.01)

(52) U.S. Cl. ..... 493/212; 493/214

(58) Field of Classification Search ..... 493/374, 493/212, 213, 210, 214, 927, 394; 53/133.4, 53/139.2

See application file for complete search history.

(56) References Cited

U.S. PATENT DOCUMENTS

| | | | | | |
|---|---|---|---|---|---|
| 3,426,396 | A | * | 2/1969 | Laguerre | 24/427 |
| 3,701,192 | A | * | 10/1972 | Laguerre | 29/768 |
| 4,758,099 | A | | 7/1988 | Branson | |
| 4,787,755 | A | | 11/1988 | Branson | |
| 4,796,300 | A | | 1/1989 | Branson | |
| 4,863,286 | A | | 9/1989 | Branson | |
| 4,927,271 | A | | 5/1990 | Branson | |
| 4,941,196 | A | | 7/1990 | Edelman et al. | |
| 5,155,967 | A | | 10/1992 | Branson | |
| 5,407,277 | A | | 4/1995 | Burke et al. | |
| 5,417,035 | A | | 5/1995 | English | |
| 5,417,495 | A | | 5/1995 | Branson | |
| 5,431,760 | A | * | 7/1995 | Donovan | 156/66 |
| 5,561,966 | A | | 10/1996 | English | |
| 5,657,943 | A | | 8/1997 | Nugent | |
| 5,664,299 | A | | 9/1997 | Porchia et al. | |
| D401,543 | S | | 11/1998 | Mobley | |
| 5,836,056 | A | | 11/1998 | Porchia et al. | |
| 5,871,281 | A | | 2/1999 | Stolmeier et al. | |
| 5,873,969 | A | | 2/1999 | Keith et al. | |
| 5,950,285 | A | | 9/1999 | Porchia et al. | |
| 5,956,815 | A | | 9/1999 | O'Connor et al. | |
| 5,956,924 | A | | 9/1999 | Thieman | |
| 6,151,868 | A | * | 11/2000 | Matthews | 53/451 |
| 6,161,271 | A | * | 12/2000 | Schreiter | 29/408 |
| 6,477,820 | B1 | * | 11/2002 | Dutra et al. | 53/412 |
| 6,477,821 | B1 | * | 11/2002 | Bois | 53/412 |
| 6,517,473 | B1 | * | 2/2003 | Cappel | 493/213 |
| 6,526,726 | B1 | * | 3/2003 | Strand et al. | 53/412 |
| 6,599,227 | B1 | * | 7/2003 | Kettner | 493/394 |
| 6,609,353 | B1 | * | 8/2003 | McMahon et al. | 53/412 |

* cited by examiner

*Primary Examiner*—Eugene Kim
(74) *Attorney, Agent, or Firm*—Barnes & Thornburg LLP

(57) ABSTRACT

A slider applicator is disclosed for applying sliders to storage bags with zippers. The slider applicator includes a slider sorter and a slider pusher actuated by an actuator such as a linear servo motor. The slider pusher includes an applicating head which moves the slider and a splitter for opening and spreading the slider prior to application to the zipper of the storage bag.

18 Claims, 8 Drawing Sheets

10
14
16
71
12
68
69
67
70
X
Y

Y
X
3
14
12
70
70
18
3

71
14
67
68
70
69
18

20
26
32
28
30
24
22
22

54
42
58
40
32
26
48
46
70
14
12
88
90
10
12
81
82
72
57
63
56
59
38
61
60

42
58
54
32
26
40
70
62
89
48
46
12
10
14
12
72
82
57
59
38
56
60
63
61

SLIDER APPLICATOR

FIELD OF THE DISCLOSURE

The present disclosure relates to product packaging, and more particularly to plastic packaging bags which include a slider and zipper for sealing the bags.

BACKGROUND AND SUMMARY

Product packaging such as plastic zippered bags are typically manufactured on a bag machine, which may include such steps as unrolling the plastic from a bulk roll, punching holes in the plastic, forming edges and ends of the bags, and applying a zippered closure to the bag. It may also be desirable to include sliders on zippered bags which facilitate easier opening and sealing of the zippered bags.

According to the disclosure an apparatus is provided that applies a slider to a zippered bag such that the slider is used to open and close the zippered bag. The slider includes a back wall and two cantilevered sides, the cantilevered sides having teeth extending inwardly therefrom. The slider is sorted by a slider sorter (i.e. a vibratory feeder bowl) which aligns the slider in the desired orientation. A track transports the slider away from the slider sorter and toward a slider pusher while maintaining the alignment of the slider.

A slider applicating head or slider pusher is also provided for receiving each slider between a front lip and a rear wall, and slidably moving each slider toward the zippered bag. The slider applicating head pivots about an axis as the slider is moved toward the zippered bag. As the slider is moved, it contacts a splitter and is consequently spread apart in order to make it over the bag's zipper. The slider applicating head is actuated by a linear servo motor.

The splitter spreads open the slider teeth prior to the slider's application to the bag. The splitter includes a first and second blade positioned to intercept the slider teeth and spread the teeth apart. The splitter illustratively moves between a first, non-use position and a second, teeth-spreading position, and is also actuated by a linear servo motor. The bag can be continually moving as the slider is applied, and the slider can be applied in a vertical or horizontal direction. One or both linear servo motors can be mounted either underneath or above a bag assembly line. The zipper can be closed or opened by the slider after the slider is applied. The apparatus can be mounted on a transportable cart that is movable between applications. The slider has an unzipping direction and a zipping direction, and the slider can be applied such that it faces either direction on the zipper. The slider is applied in a direction substantially perpendicular to the direction of travel of the bag.

A bag guide is also disclosed for laterally retaining the bag when the slider is applied to the zipper of the bag. The bag guide is configured to permit movement of the bag on the conveyor while the slider is being applied and simultaneously control lateral movement of the bag away from the slider applicator.

The slider applicator comprises a slider sorter, a track, a slider pusher, a splitter, and an actuator coupled to the slider pusher and configured to move the slider pusher in response to signals from a component on the bag machine. The applicator comprises an upper portion above the bag machine line and a lower portion below the bag machine line, and the actuator can be mounted on the lower portion of the slider applicator.

A method of applying a slider to a bag having a zipper is also disclosed. The method comprises the steps of aligning the slider in a predetermined orientation, presenting the slider to a slider pusher, moving the zippered bag in front of the slider pusher, and moving the slider pusher toward the bag such that the slider is applied to the zipper while the bag is in motion.

BRIEF SUMMARY OF THE DRAWINGS

The detailed description particularly refers to the accompanying figures in which.

DETAILED DESCRIPTION

Figure 1:
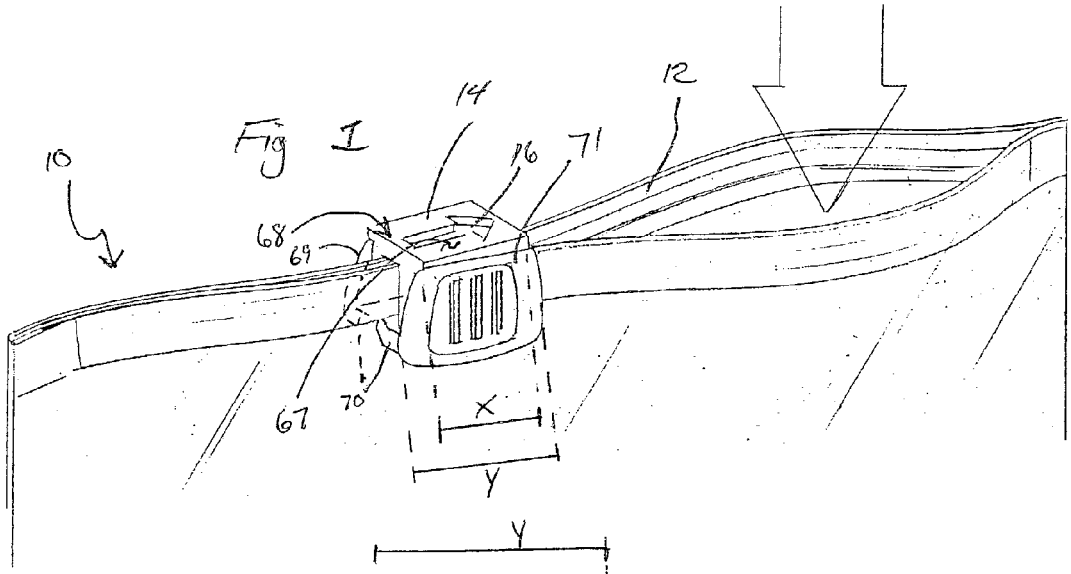
FIG. 1 is a perspective view of a zippered bag having a slider.

A package for a product is illustratively shown in FIG. 1 as a plastic bag 10. Bag 10 is formed to include a zipper 12 on one end that is opened and closed by actuating slider 14. Illustratively, slider 14 seals zipper 12 and thereby closes bag 10 when slider 14 is moved in the direction indicated by arrow 16. Likewise, slider 14 opens bag 10 when slider 14 is moved in the opposite direction of arrow 16.

Figure 2:
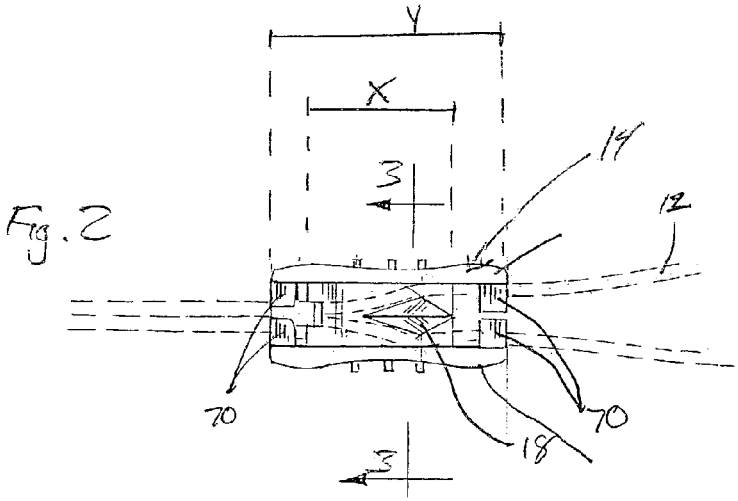
FIG. 2 is a view of the slider as viewed from inside the zippered bag.
Figure 3:
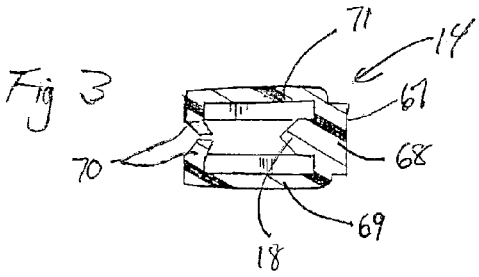
FIG. 3 is a cross-sectional view of the slider, taken along the line 3—3 of FIG. 2.
Figure 12:
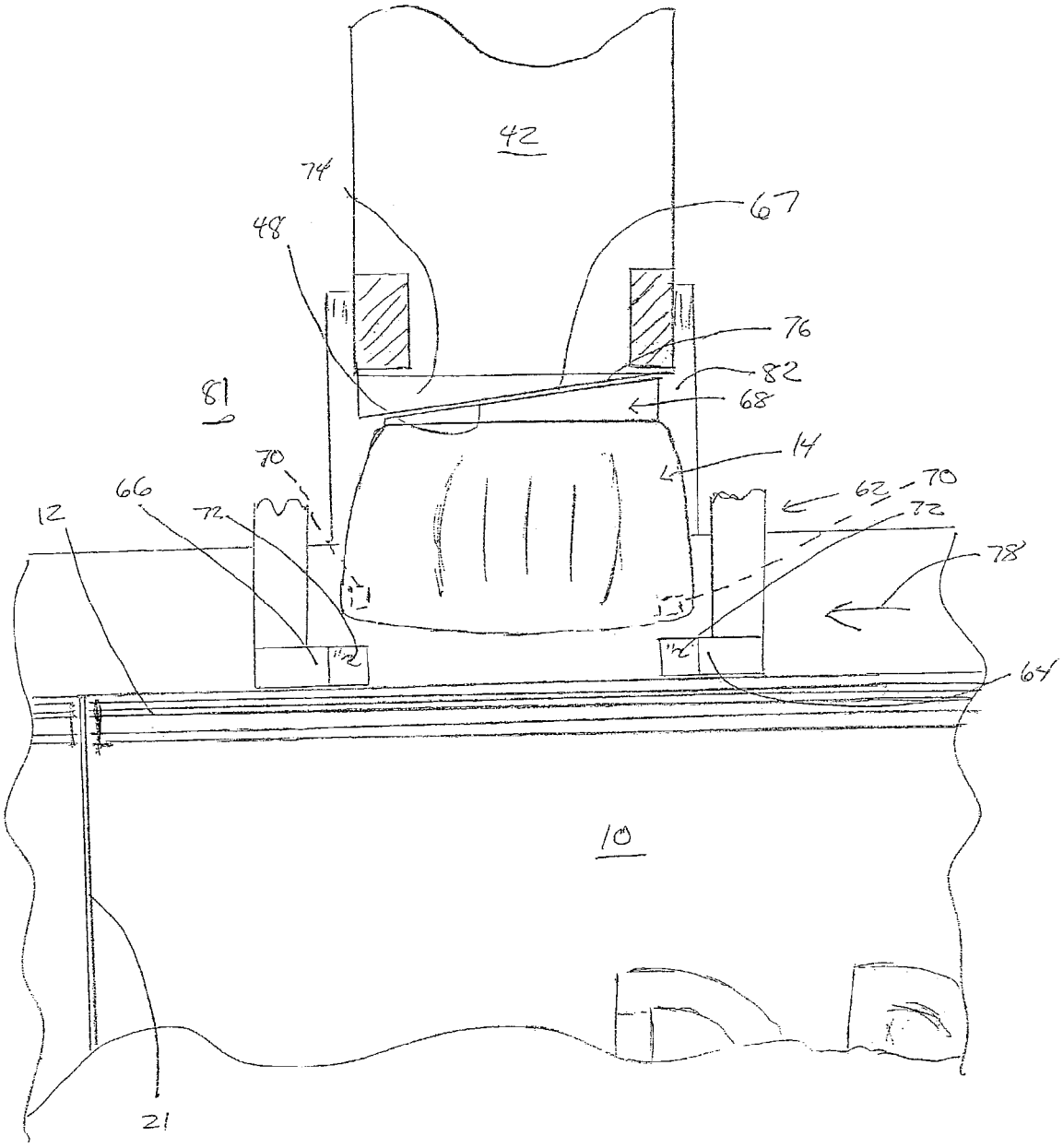
FIG. 12 is sectional view taken along the line 12—12 of FIG. 9, showing the slider applicating head moving the slider toward the splitter and the adjoining bag.

As can be seen in FIGS. 1 and 2, slider 14 includes a back wall 68 having a dimension X and a two cantilevered side walls 69, 71, which define a dimension Y. Side walls 69, 71 illustratively have teeth 70 formed thereon. Teeth 70 are shown positioned on side walls 69, 71 at points outside of the dimension X of the back wall 68, as can be seen in FIG. 2 and FIG. 12. Such an embodiment allows teeth 70 to be spread apart, as discussed below, when slider 14 is introduced to a splitter 62 (shown in FIGS. 10 and 12), while not causing back wall 68 to be caught on splitter 62 as it passes.

FIG. 2 shows slider 14 and zipper 12 as viewed from inside bag 10. Slider 14 illustratively includes a central keel 18 which functions to separate the zipper when the slider is moved to the open position. It should be understood, however, that other slider and zipper configurations are within the scope of the disclosure, and the slider applicator as described further herein can be modified to accommodate other sliders and zippers known in the art.

Figure 4:
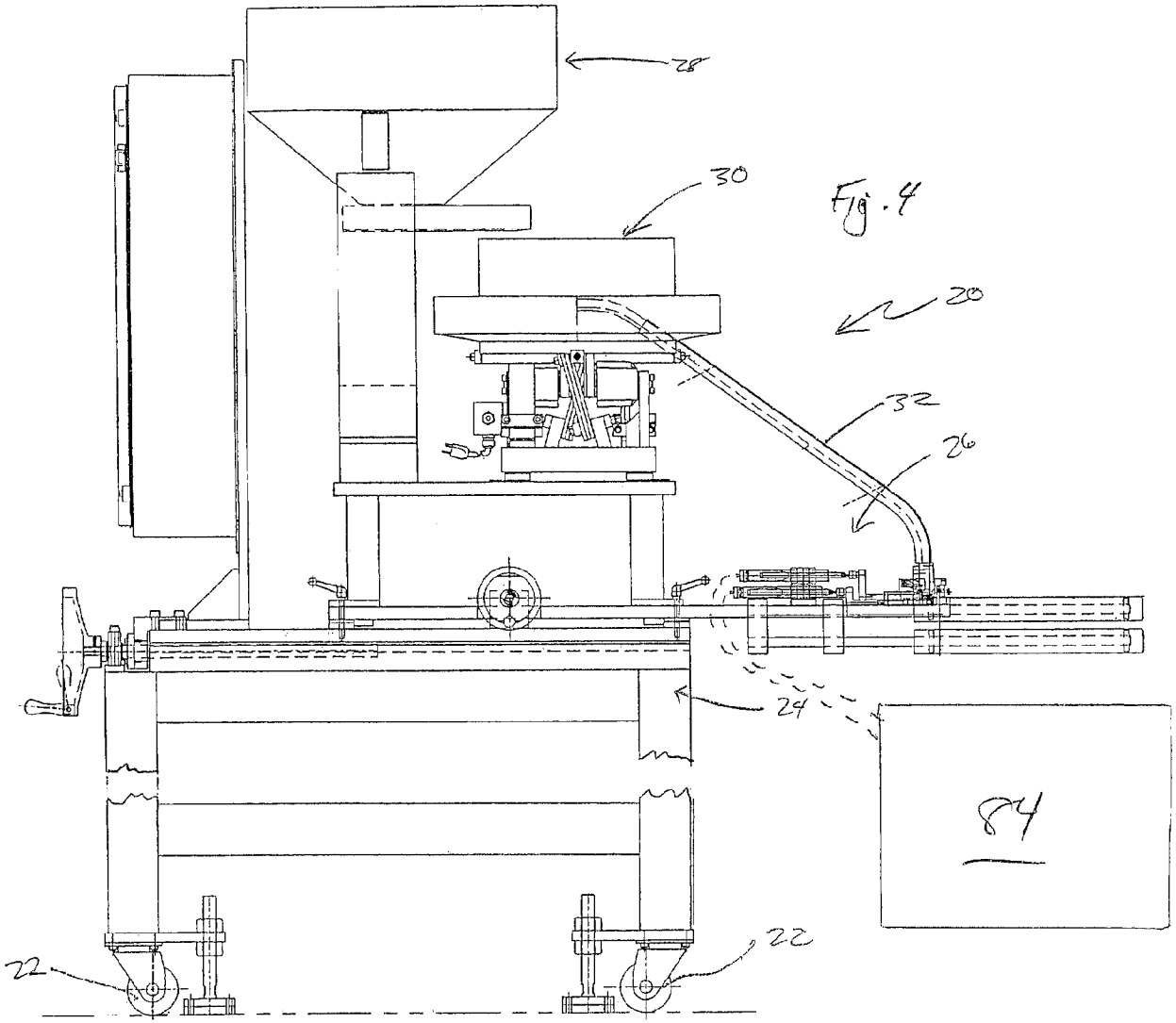
FIG. 4 is an elevation view of one embodiment of the disclosure, wherein the slider applicator is mounted on a movable cart and adapted to be inserted in a bag machine.

A slider applicator 20 is shown in one embodiment in FIG. 4. In the illustrated embodiment, slider applicator 20 is a transportable unit having wheels 22 which allow applicator 20 to be easily moved between conveyors or bag machines. However, it should be understood that slider applicator 20 can alternatively be directly mounted on a bag machine 36 and incorporate all of the features disclosed herein.

As can be seen in FIG. 4, slider applicator 20 illustratively includes a frame 24 carrying a slider pusher 26, a slider funnel 28, and a slider sorter 30. Slider funnel 28 receives and holds sliders 14 before they are fed into slider sorter 30. Slider sorter 30 illustratively aligns sliders 14 in a desired orientation using a vibration method, as is disclosed in U.S. Pat. No. 4,429,808, incorporated herein by reference. The aligned sliders 14 then travel to slider pusher 26 via track 32.

Figure 5:
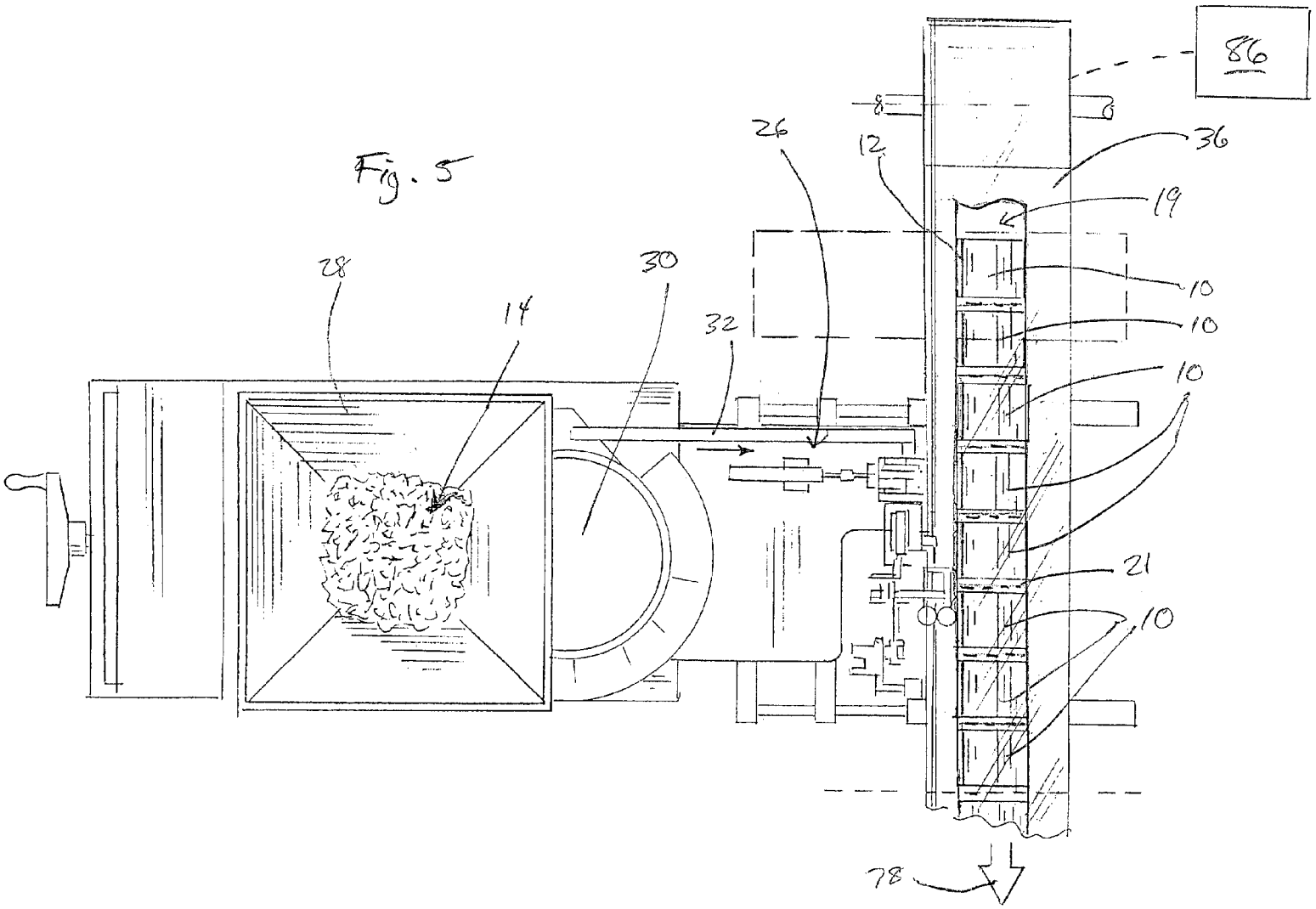
FIG. 5 is a top view of the embodiment shown in FIG. 4.

A top view of the slider applicator of FIG. 4 is shown in FIG. 5, wherein slider funnel 28 is shown holding sliders 14 prior to their introduction to slider sorter 30. Slider sorter 30 delivers aligned sliders 14 to slider pusher 26 via track 32, and slider pusher 26 applies sliders 14 to bags 10 as they are moved along bag machine 36. Illustratively, bags 10 are formed from a roll or rolls 19 of plastic, and bags 10 are separated along line 21 some time after sliders 14 are applied. As discussed above, sliders 14 function to close bag 10 when moved in one direction (indicated by arrow 16 in FIG. 1) and open bag 10 when moved in the opposite direction. Depending on the direction in which it is desired that sliders 14 face upon application to bag 10, track 32 may be attached to slider pusher 26 on an opposite side of that shown in FIG. 5, or slider sorter 30 and track 32 may be configured to present sliders 14 facing the opposite direction.

Illustratively, back wall 68 of slider 14 is formed such that top surface 67 is inclined or ramped relative to the direction of travel of slider 14, as can be seen in FIGS. 1 and 12. The inclined top surface 67 allows for easier movement of slider 14 in the closing direction (indicated by arrow 16 in FIG. 1) when a user's finger is placed on the top surface 67.

In order to accommodate the inclined top surface 67, slider pusher 26 can be configured to have a rear wall 48 that is angled (or ramped) relative to front lip 46. As illustratively shown in FIG. 12, an angled insert 74 provides the desirable angled rear wall while accommodating for sliders 14 that can be fed from either direction. Angled insert 74, which is illustratively wedge-shaped, is shown positioned such that pointed end 76 of insert 74 points upstream (with reference to the direction 78 that bags 10 are moving) and wide end 80 is downstream of pointed end 76. If the slider 14 is oriented oppositely, pointed end 76 of insert 74 can be positioned to be downstream of wide end 80.

Figure 6:
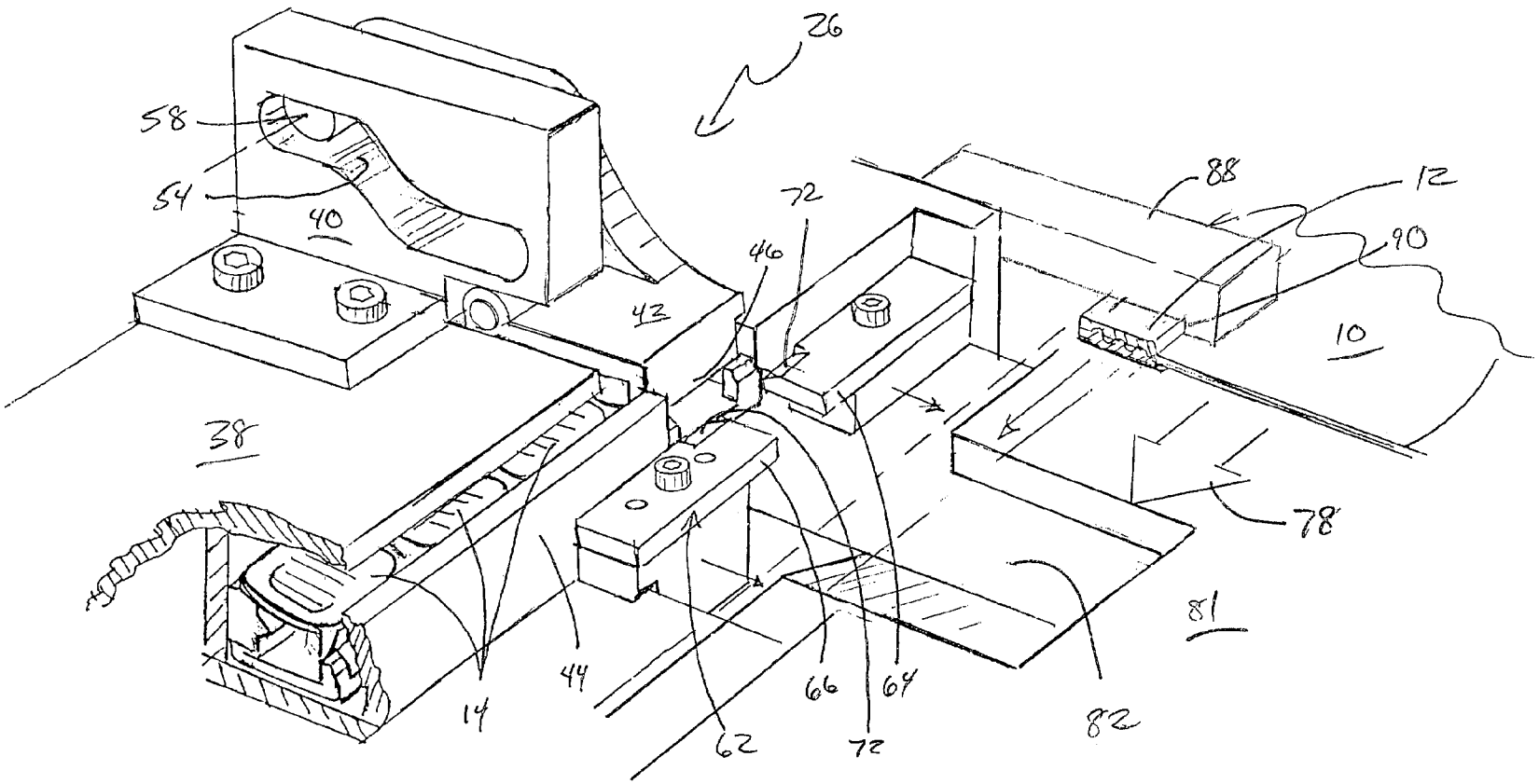
FIG. 6 is a perspective view of the slider pusher positioned to apply a slider on the zippered bag passing in front.
Figure 7:
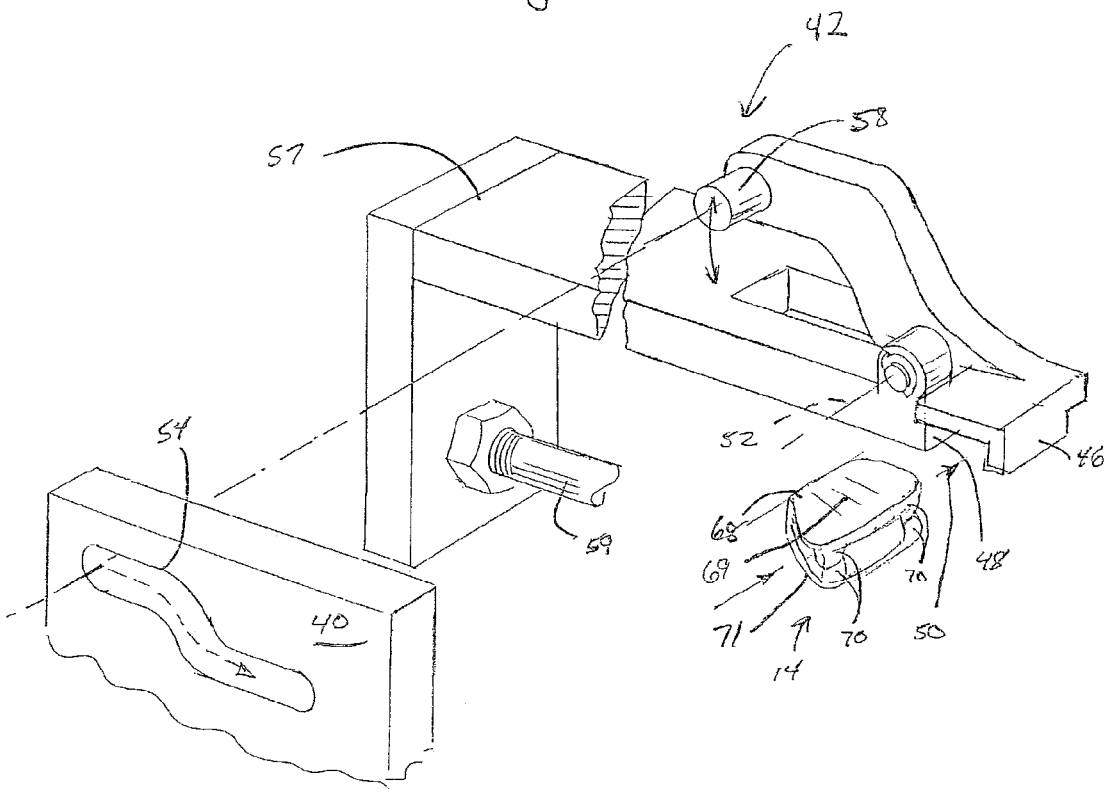
FIG. 7 is an exploded view showing the slider applicating head.

Portions of slider pusher 26 are illustratively shown in FIG. 6. Pusher frame 38 carries a guide 40 which guides movement of slider applicating head 42. Head 42 illustratively receives one slider 14 at a time from channel 44. After slider 14 is moved in direction 50 (shown in FIG. 7) and received by head 42, the slider 14 is held in position between front lip 46 and rear wall 48 (shown in FIG. 9). Head 42 is illustratively pivotable about axis 52 (FIG. 7), and guide 40 causes pivoting of head 42 when slider applicating head 42 is moved toward bag 10 due to the curvature of slot 54 formed in guide 40.

Figure 8:
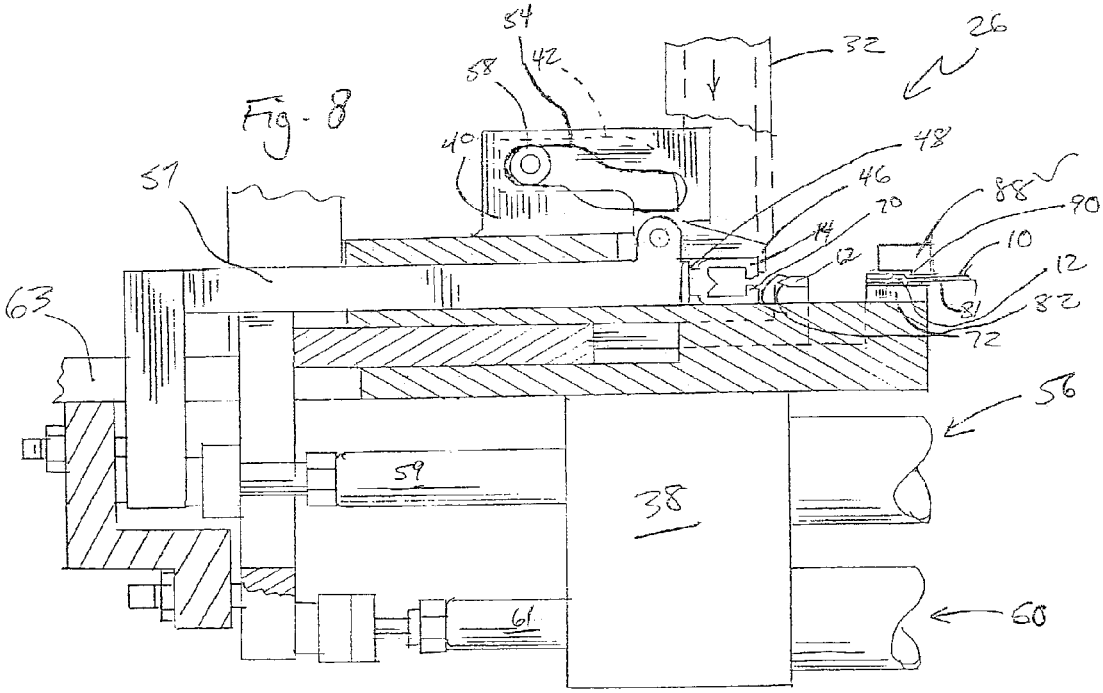
FIG. 8 is an elevation view of another embodiment showing actuators positioned below the bag machine and showing a slider splitter moving toward the zippered bag.
Figure 10:
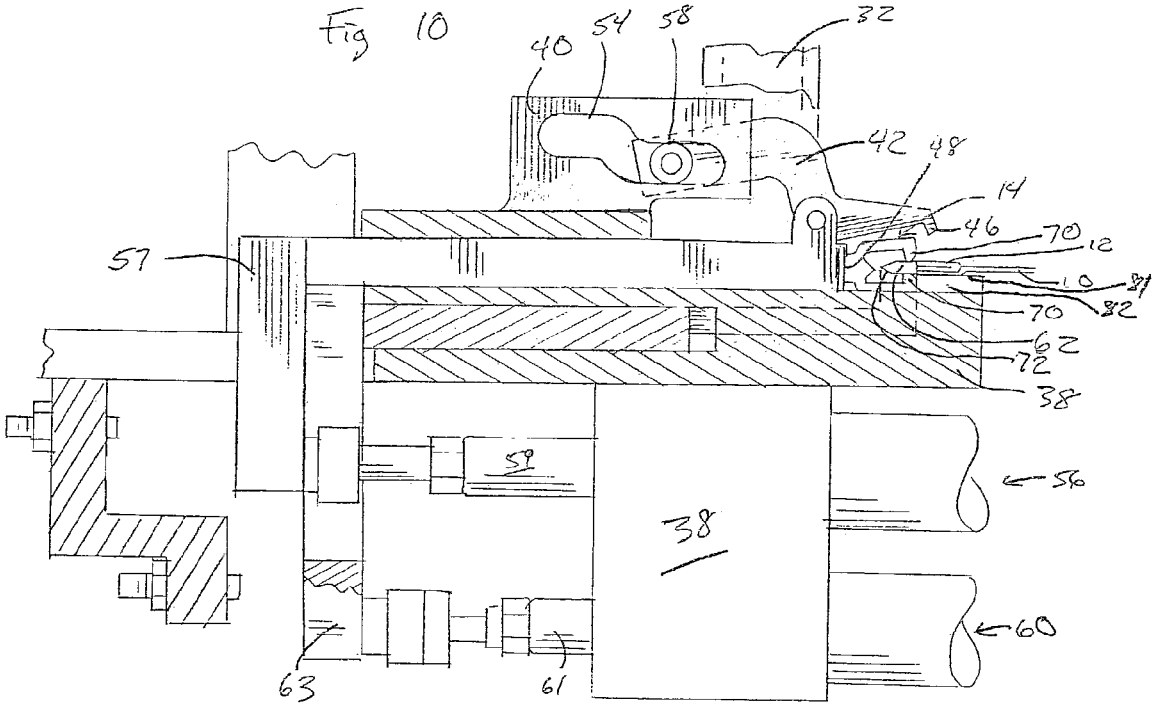
FIG. 10 is an elevation view showing the slider applicating head moving a slider over the slider spreader.
Figure 11:
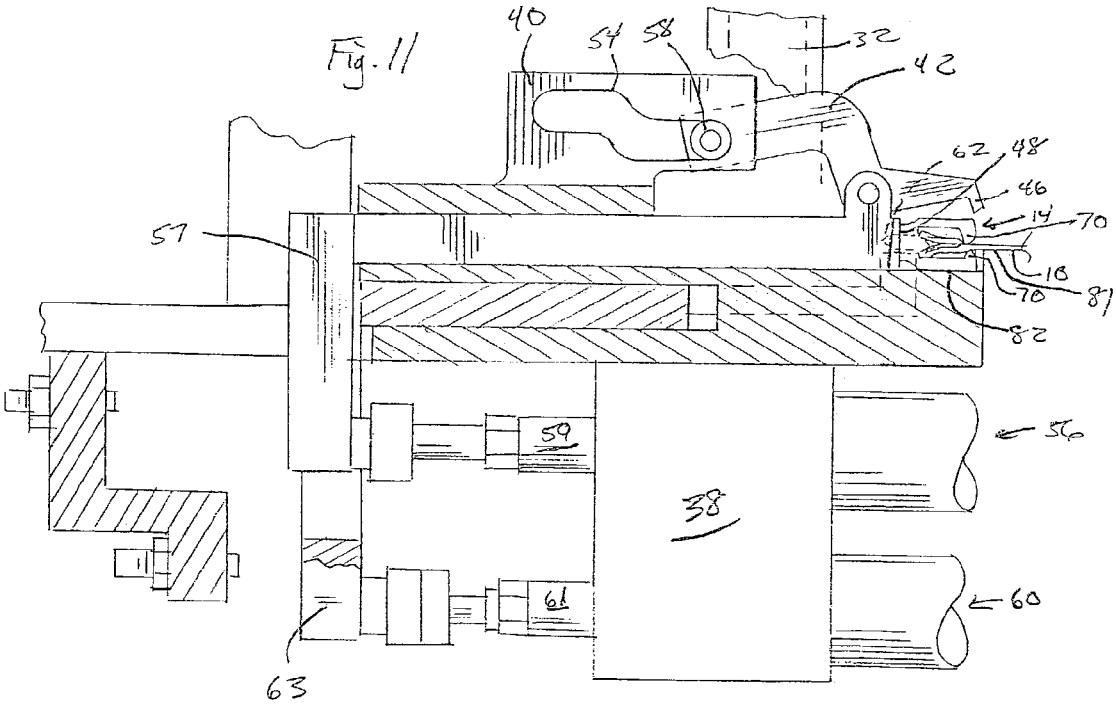
FIG. 11 is an elevation view showing the slider positioned on the zippered bag.

An actuator 56, illustratively a linear servo motor, is connected to head 42 via arm 57 (viewed in FIGS. 7–10) and moves head 42 between a first, slider-receiving position, as shown in FIG. 8, and a second, slider-placing position, as shown in FIG. 11. Plunger 59 connects arm 57 to actuator 56, plunger 59 being configured to be moved into and out of the linear servo motor 56.

The linear servo motor is illustratively manufactured by LinMot as part number 0150–1103. LinMot is a Swiss manufacturer with US offices at N2444 Broad Street, Delavan, Wis. 53115, phone number 877-804-0718. Illustratively, other products configured to cooperate with the linear servo motor are incorporated in the slider applicator 20, such as a motor extension cable LinMot #0150-1913, a motor mounting flange, LinMot #0150-1901, a 2-axis controller, LinMot #0150-1602, an I/O breakout board, LinMot #0150-1932, a connector kit, LinMot #0150-1934, and a 48 VDC Power Supply, LinMot #0150-1940. LinMot parts can be linked in a number of ways to accomplish the given task, and a LinMot representative can suggest a manner for constructing and aligning the LinMot parts to control the various elements of the slider applicator 20.

During movement of plunger 59 and arm 57, cam follower 58 slides in linear cam slot 54 of guide 40, pivoting head 42 about axis 52 as head 42 is moved between the first and second positions, as can be seen in FIGS. 6–11. The pivoting movement of head 42 causes front lip 46 to pivot away from slider 14, allowing slider 14 to spread open and subsequently engage zipper 12, as is discussed below.

A second actuator 60, also illustratively a linear servo motor manufactured by LinMot as part number 0150-1103, controls movement of splitter 62. Illustratively, second actuator 60 comprises a plunger 61 which is connected to arm 63. As can be seen in FIG. 6, splitter 62 is mounted on arm 63 and moves from a first position shown in FIGS. 6 and 8 to a second position shown in FIG. 9, wherein slider 14 can be spread open, as shown in FIG. 10, and passed over zipper 12, as shown in FIG. 11. Splitter 62 illustratively comprises two cantilevered blades 64, 66 which are spaced a sufficient distance (as can be seen in FIGS. 6 and 12) to allow for back wall 68 of slider 14 (see FIG. 12) to pass between the blades 64, 66; however, cantilevered blades 64, 66 are positioned sufficiently close that teeth 70 of slider 14 contact cantilevered blades 64, 66 and resultingly spread apart as they pass over blades 64, 66. Illustratively, blades 64, 66 are formed to include ramped leading edges 72 which contact teeth 70 as they are spread apart to pass over blades 64, 66.

Bag 10 is illustratively laterally supported in its position relative to slider applicator 20 by a bag guide 88, as shown in cross-section in FIG. 8. Bag guide 88 is illustratively an L-shaped (in cross-section) piece of machined metal, and is mounted on pusher frame 38 as shown in FIG. 10 such that zipper 12 passes below bag guide 88 and is held in its lateral position by lip 90 of bag guide 88. It is contemplated that bag guide 88 may be placed in positions other than the mounting position shown in FIG. 10, and likewise may be omitted from slider applicator 20 if tension on bags 10 can be maintained enough that the application of slider 14 does not cause bag 10 to move laterally. It should be understood that bag guide 88 is not shown in other drawings for purposes of allowing other components to be viewed.

Actuators 56, 60 are shown positioned below bag machine 36 in FIGS. 8–11, however, it is within the scope of the disclosure to structure slider applicator 20 such that actuators 56, 60 are positioned above bag machine 36. The illustrative positioning of actuators 56, 60 below bag machine 36 provides the advantage of saving space above the line 36, where other functions occur and other mechanisms might require space.

During use, slider applicator 20 operates substantially as follows. A bag machine 36, as shown illustratively in FIG. 5, presents bags 10 to various components along the bag machine 36 to accomplish, for example, attachment of zipper 12, punching of holes in bags 10, and formation of bag peripheries. Illustratively, motor 86 (shown diagrammatically in FIG. 5) drives bags 10 down the bag machine in the direction 78, shown in FIGS. 5 and 12. It will appreciated that the present disclosure permits the movement of bags 10 at a substantially constant rate along bag machine 36. However, other components along bag machine 36 may limit the ability to move bags 10 at a constant rate. Regardless, the present disclosure will provide for such constant movement if the application permits.

As can be seen in FIG. 4, sliders 14 are fed into and held in slider funnel 28 until they are transferred to slider sorter 30, which aligns sliders 14 prior to their transfer to track 32. Track 32 carries sliders 14 in single file to slider pusher 26. Slider pusher accepts one slider 14 at a time through channel 44, shown in FIG. 6.

Figure 9:
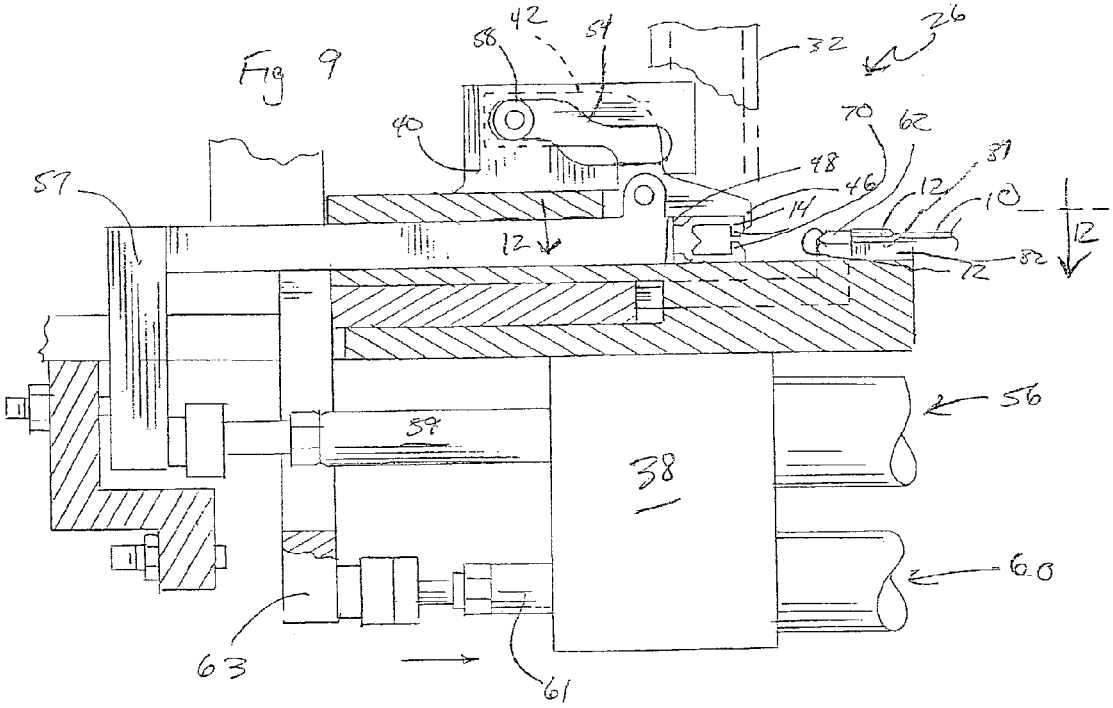
FIG. 9 is an elevation view similar to that of FIG. 8 showing the splitter in position in front of the zippered bag.

After a slider 14 is positioned between front lip 46 and rear wall 48, as shown in FIG. 8, second actuator 60 receives signals from a processor or other machine component and responsively moves splitter 62 from the first position shown in FIGS. 6 and 8 to the second position shown in FIG. 9, such that splitter 62 is now positioned substantially adjacent zipper 12 of bag 10. Such signals received by second actuator 60 may originate from a processor which is operating bag machine 36, or from another component associated with bag machine 36, such as a bag placement sensor or a hole puncher.

A controller 84, as shown diagrammatically in FIG. 4, may also be coupled to the slider applicator 20 for controlling the operation of actuators 56, 60. Controller 84 illustratively includes an on-board processor and can be used to process signals from the aforesaid other component and control actuation of actuators 56, 60. Although other components currently require bags 10 to stop for various processes, bags 10 need not be slowed down or halted when splitter 62 moves to a position adjacent bag 10. Consequently, production speed for bag machine 36 is not hindered or slowed by the slider application process.

At some point, actuator 56, illustratively in response to signals from controller 84, begins to move head 42 from the first position shown in FIGS. 6, 8, and 9 to the second position shown in FIG. 11. Splitter 62 is positioned in its second position prior to head 42 moving slider 14 into contact with splitter 62, thereby spreading slider 14 open, as shown in FIG. 10. Also, as head 42 moves toward its second position, slot 54 in guide 40 cooperates with cam follower 58 on head 42 to cause head 42 to rotate about axis 52 (shown in FIG. 5) and thereby pivot front lip 46 away from slider 14.

Illustratively, slider pusher 26 includes a bag support 81 defining a groove 82 therein, as shown in FIGS. 6 and 8–12. Groove 82 directs slider 14 in the desired perpendicular direction relative to direction 78 (shown in FIGS. 6 and 12) of travel of bags 10.

As slider 14 approaches splitter 62, slider teeth 70 contact leading edges 72 of splitter blades 64, 66, and begin to spread apart, as shown in FIG. 10. Splitter blades 64, 66 spread teeth 70 a sufficient amount to allow teeth 70 to pass over zipper 12, and then teeth 70 draw back together after passing zipper 12, as can be seen in FIG. 11. Thereafter, both splitter 62 and head 42 retract to their respective first positions, shown in FIGS. 6 and 8, and another slider 14 is fed between front lip 46 and rear wall 48 of head 42. Controller 84 illustratively sends a signal back to the bag machine processor or other component upon application of slider 14 to zipper 12.

Slider 14 is illustratively applied to zipper 12 when zipper 12 is in the closed position. The present disclosure also contemplates that a click lock need not be applied to bag 10, although it is within the disclosure to apply one. A click lock, similar to a slider 14, is applied to the bag 10 after the zipper is attached to the bag 10. A click lock typically functions to define one boundary of the slider on a zipper. Click locks can also hold a slider 14 in the closed position, the slider being urged open with either sufficient pressure or by moving a latch, or in other manners known in the art. The construction of the present disclosure allows zippers to be applied vertically, or in any direction, although such an embodiment is not illustrated in the drawings.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as expressed by the following numbered features and elements.

There is a plurality of advantages of the present disclosure arising from the various features of the slider applicator described herein. It will be noted that alternative embodiments of the slider applicator of the present disclosure may not include all of the features described yet still benefit from at least some of the advantages of such features. Those of ordinary skill in the art may readily devise their own implementations of a slider applicator that incorporates one or more of the features of the present disclosure and falls within the spirit and scope of the present disclosure as defined by the following numbered features and elements.

What is claimed is:

1. An apparatus for applying a slider to a zippered bag, wherein the slider has a back wall and two cantilevered side walls, the apparatus comprising a bag machine configured to move a zippered bag in a substantially linear direction to present the zippered bag to a slider pusher, a slider sorter configured to align the slider in a desired orientation, a track configured to maintain the alignment of the slider while transporting the slider away from the slider sorter, a slider pusher configured to receive the slider from the track and move the slider substantially perpendicular to the substantially linear direction and toward the zippered bag, a splitter comprising separate blades configured to spread the cantilevered side walls of the slider and allow the back wall to pass between the blades as the slider is moved into engagement with the zippered bag, and a bag machine configured to present the zippered bag to the slider pusher, the apparatus being configured to apply the slider while the zippered bag is in motion.

2. The apparatus of claim 1, wherein the splitter is moveable with respect to the bag and zipper and configured to fit between and wedge open the cantilevered side walls of the slider prior to the slider's engagement with the zippered bag.

3. The apparatus of claim 1, wherein the slider is oriented in a selected one of two directions when it is received by the slider pusher.

4. The apparatus of claim 3, wherein the slider pusher includes a slider application head having a front lip and a rear wall, the front lip and rear wall cooperating to define a slider-receiving space there between.

5. The apparatus of claim 4, wherein the back wall of the slider is ramped in order to facilitate finger-actuation of the slider, and the rear wall of the slider application head is ramped an equal degree in the opposite direction in order to accommodate the slider.

6. The apparatus of claim 5, wherein the rear wall of the slider application head comprises an interchangeable ramped surface for accommodating sliders oriented in either direction.

7. The apparatus of claim 1, further comprising a bag guide for laterally retaining the bag in place when the slider is applied to the bag.

8. The apparatus of claim 1, wherein the slider has a back wall connecting two cantilevered side walls with teeth on the ends of each side wall and the slider pusher is configured to move the slider toward the zippered bag so that all of the teeth pass over the zipper substantially simultaneously.

9. An apparatus for applying a slider to a zippered bag, the apparatus comprising a bag machine configured to transport the zippered bag, and a slider applicator configured to apply a slider to the zippered bag as it is transported by the bag machine, the slider applicator comprising an upper portion above the bag machine and a lower portion below the bag machine, the slider applicator comprising a slider sorter configured to align the slider in a desired orientation, a track configured to maintain the alignment of the slider while transporting the slider away from the slider sorter, a slider pusher configured to receive the slider from the track and move the slider toward the zippered bag, an actuator coupled to the slider pusher and configured to move the slider pusher in response to signals from a component on the bag machine, a splitter comprising separate blades, the splitter being moveable with respect to the bag and zipper and configured to fit between and wedge open the cantilevered side walls of the slider prior to the slider's engagement with the zippered bag, the splitter being configured to allow the back wall of the slider to pass between the blades as the slider is being applied to the bag, the actuator being mounted on the lower portion of the slider applicator.

10. The apparatus of claim 9, further comprising a bag guide mounted to the upper portion, the bag guide being configured to permit movement of the bag and simultaneously control lateral movement of the bag away from the slider applicator.

11. An apparatus for applying a slider to a zippered bag on a bag machine, the bag machine substantially defining a plane, the slider having a back wall connecting two cantilevered side walls with teeth on the ends of each side wall and the zippered bag having a zipper, the apparatus comprising a transportable frame capable of being moved between the bag machine and a second bag machine, a slider sorter coupled to the frame, the slider sorter being configured to align the slider in a desired orientation, a slider pusher coupled to the slider sorter and configured to move the slider toward the zippered bag so that all of the teeth pass over the zipper substantially simultaneously, the slider pusher being actuated by an actuator positioned below the plane defined by the bag machine, and splitter blades configured to spread the cantilevered side walls of the slider prior to the slider's engagement with the zippered bag and allow the back wall to pass between the blades as the slider is being applied to the bag.

12. A method of applying a slider to a bag having a zipper wherein the slider has a back wall and two cantilevered side walls, the method comprising the steps of aligning the slider in a predetermined orientation, presenting the slider to a slider pusher, moving the zippered bag in a substantially linear direction in front of the slider pusher, and moving the slider pusher substantially perpendicular to the substantially linear direction toward the bag and applying the slider to the zipper while the bag is in motion, with the slider pusher moving toward the bag so that the slider is caused to contact splitter blades thereby causing cantilevered side walls of the slider to spread apart prior to engaging the zipper and allowing the back wall of the slider to pass between the blades as the slider is being applied to the bag.

13. The method of claim 12, wherein the splitter moves into position adjacent the bag and zipper, wedges open the cantilevered side walls of the slider prior to the slider's engagement with the zippered bag and moves away from the bag and zipper.

14. The method of claim 13, wherein the supported for movement on top of a bag machine and the linear servo motor is positioned below a plane defined by the bag machine.

15. The method of claim 12, wherein the slider has a back wall and two cantilevered side walls, and the slider applying step includes moving the slider into contact with a splitter such that the splitter causes the cantilevered side walls to spread apart enough to pass over the zipper.

16. The method of claim 12, wherein the splitter is actuated by a linear servo motor independently of the slider pusher.

17. The method of claim 15, wherein the splitter has a first non-spreading position, and a second slider-spreading position wherein the splitter is positioned adjacent the moving bag.

18. The apparatus of claim 11, wherein the splitter is moveable with respect to the bag and zipper and configured to fit between and wedge open the cantilevered side walls of the slider prior to the slider's engagement with the zippered bag.

* * * * *